US007090089B2

(12) United States Patent
Lown et al.

(10) Patent No.: US 7,090,089 B2
(45) Date of Patent: Aug. 15, 2006

(54) CONTAINER AND SEALING COVER

(75) Inventors: John M. Lown, Huntington Beach, CA (US); David A. Melvin, Porterville, CA (US)

(73) Assignee: Snapware Corporation, Mira Loma, CA (US)

( * ) Notice: Subject to any disclaimer, the term of this patent is extended or adjusted under 35 U.S.C. 154(b) by 264 days.

(21) Appl. No.: 10/717,044

(22) Filed: Nov. 19, 2003

(65) Prior Publication Data

US 2004/0099669 A1 May 27, 2004

Related U.S. Application Data

(63) Continuation of application No. 10/204,684, filed as application No. PCT/US01/41317 on Jul. 10, 2001, now abandoned.

(51) Int. Cl.
*B65D 45/16* (2006.01)

(52) U.S. Cl. ..... 220/324; 220/780

(58) Field of Classification Search ..... 220/324, 220/780–794, 796, 799; 206/508, 503; 298/180, 298/181, DIG. 14, DIG. 30, 358, 309
See application file for complete search history.

(56) References Cited

U.S. PATENT DOCUMENTS 4,765,506 A * 8/1988 Fishman et al. ..... 220/792
5,383,565 A * 1/1995 Luch ..... 215/317
5,520,301 A * 5/1996 Sohn ..... 220/265
5,531,345 A * 7/1996 Nakamura et al. ..... 220/3.8
5,641,065 A * 6/1997 Owens et al. ..... 206/370
6,269,967 B1 * 8/2001 de Vries ..... 220/669
6,279,774 B1 * 8/2001 Clute et al. ..... 220/792
6,793,096 B1 * 9/2004 Seok ..... 220/788

* cited by examiner

*Primary Examiner*—Lien M. Ngo
(74) *Attorney, Agent, or Firm*—Harold L. Jackson

(57) ABSTRACT

A container and sealable cover in which the container has a bottom wall and an upstanding peripheral wall terminating in an upper edge surrounding an open mouth. The peripheral wall is inclined outwardly at a slight angle to the vertical or alternatively vertically disposed. A replaceable cover is provided with a central top planar wall and an inverted U-shaped periphery terminating in an outer rim skirt. A contiguous downwardly extending sealing fin is disposed inwardly of the skirt for forming an interference fit with the inside surface of the upper portion of the container peripheral wall when the cover is installed over the container mouth. The fin may be substantially vertically disposed or canted outwardly at a small angle to the vertical depending upon the inclination of the peripheral wall. A pair of latches are rotatably mounted on the cover adjacent the outer rim skirt and arranged to engage protruding latch hooks on the container peripheral wall to releasably secure the cover over the container mouth.

29 Claims, 17 Drawing Sheets

CONTAINER AND SEALING COVER

RELATED APPLICATION

This application is a continuation of application Ser. No. 10/204,684 filed Aug. 23, 2002 now abandoned entitled CONTAINER AND SEALING COVER which is a 371 of PCT/US01/41317 filed Jul. 10, 2001 claims priority to and PCT/US01/02434, filed Jan. 25, 2001, entitled CONTAINER AND SEALING COVER.

FIELD OF THE INVENTION

This invention relates generally to a container for storing foods, liquids and other articles and a replaceable cover or lid capable of providing a tight seal and more particularly to the container cover which is suitable for use in microwave cooking and in automatic dish washers.

BACKGROUND ART AND OBJECTS OF THE INVENTION

Food storage containers are generally made of a plastic material such as polypropylene or polyethylene polymers or copolymers. Such containers are normally fairly rigid, but may be subject to some amount of flexure especially where the lid or cover is arranged to be peeled off of the container mouth. Most such container/lid configurations provide a sealing bead or rim along the upper wall of the container with a mating channel on the lid which engages the bead as well as the adjacent inner and outer surfaces of the container wall. Such sealing arrangements generally require considerable effort to force the lid onto the sealing bead during the closing procedure and perhaps greater effort to peal the lid away from the container during the opening process. While some lids are provided with one or more outwardly extending tabs to accommodate a user's fingers, the opening procedure may be quite difficult for a person suffering from arthritis or tendinitis. In addition, the lids of such sealable containers often become distorted through heating, dishwashing or refrigeration procedures making lid replacement difficult or impossible. In addition containers designed for microwave use are generally provided with a separate vent located in the lid for preventing pressure build up.

In some designs a separate sealing member such as an O-ring or annular gasket is disposed between the container rim and the lid channel to provide a more secure seal. Such designs may rely on frictional forces to maintain the lid in place on the container or may rely on latching arms carried by the lids which engage retention lips on the container. In either case the separate sealing member, i.e., O-ring or gasket involves not only added manufacturing costs, but is subject to being misplaced or lost during use of the container.

There is a need for a more user friendly food storage container/cover which overcomes the above shortcomings.

SUMMARY OF THE INVENTION

A container in accordance with the present invention includes a bottom wall and an upstanding peripheral wall terminating in an upper edge surrounding an open top or mouth. At least an upper portion of the wall defines an inside sealing surface which circumscribes the wall below the peripheral edge. While the container is preferably rectangularly-shaped, it may also be circular or oval in shape.

A replaceable cover is provided which includes a top, preferably dish-shaped, with a planar top wall terminating in a downwardly extending outer rim flange or skirt. The skirt is arranged to fit over a substantial portion of the upper edge of the container. The cover includes a downwardly extending inner sealing flange circumscribing the cover inwardly of the outer flange. The sealing flange has a lower section terminating in a free edge, the perimeter of which is greater than the perimeter of the container sealing surface so that the lower section of the sealing flange forms an interference fit with the inside sealing surface of the container wall when the cover is pressed downwardly over the mouth or open top of the container.

A pair of latch handles are pivotally mounted on opposite sides of the cover along the outer rim flange thereof with each latch handle being provided with a protruding locking tab arranged to snap under a section of the peripheral upper edge of the container wall when the latch handle is rotated downwardly to lock the cover in a sealing relationship over the container mouth. The outer rim skirt of the cover does not extend under the peripheral upper edge of the cover so that the cover can be readily removed when the latch handles are rotated upwardly to disengage the locking tabs from the peripheral upper edge of the container. Also when one of the latch handles is rotated to its unlocked position expanded fluid within the container will cause the lid (or a portion thereof) to rise slightly during microwave cooking to provide the necessary venting action to prevent excess pressure build-up.

In one embodiment the upper portion of the container peripheral wall is inclined outwardly at a slight angle to the vertical, say 2° to 5° and the sealing flange is substantially vertical.

In an alternative embodiment the upper portion of the container wall and the inside sealing surface defined thereby is substantially vertically disposed and the sealing flange is outwardly canted, when the bottom wall is positioned on a horizontal plane. The sealing flange seats against the inside sealing surface of the container wall when the cover is pressed downwardly over the mouth or open top of the container to form the interference fit. As an additional feature, to facilitate mating and unmating the container and cover, the uppermost portion of the wall defines a transition or lead in surface for guiding the sealing flange into registry with the container sealing surface. Such transition surface may be inclined outwardly at an angle to the vertical, e.g., 45° or less, when the bottom wall is positioned in a horizontal plane.

The construction and function of preferred embodiments of the container/cover arrangement of the present invention may best be understood by reference to the following description taken in conjunction with the accompanying drawings in which like components are designated by the same reference numeral in the several figures.

DESCRIPTION OF THE PREFERRED EMBODIMENT

Figure 1:
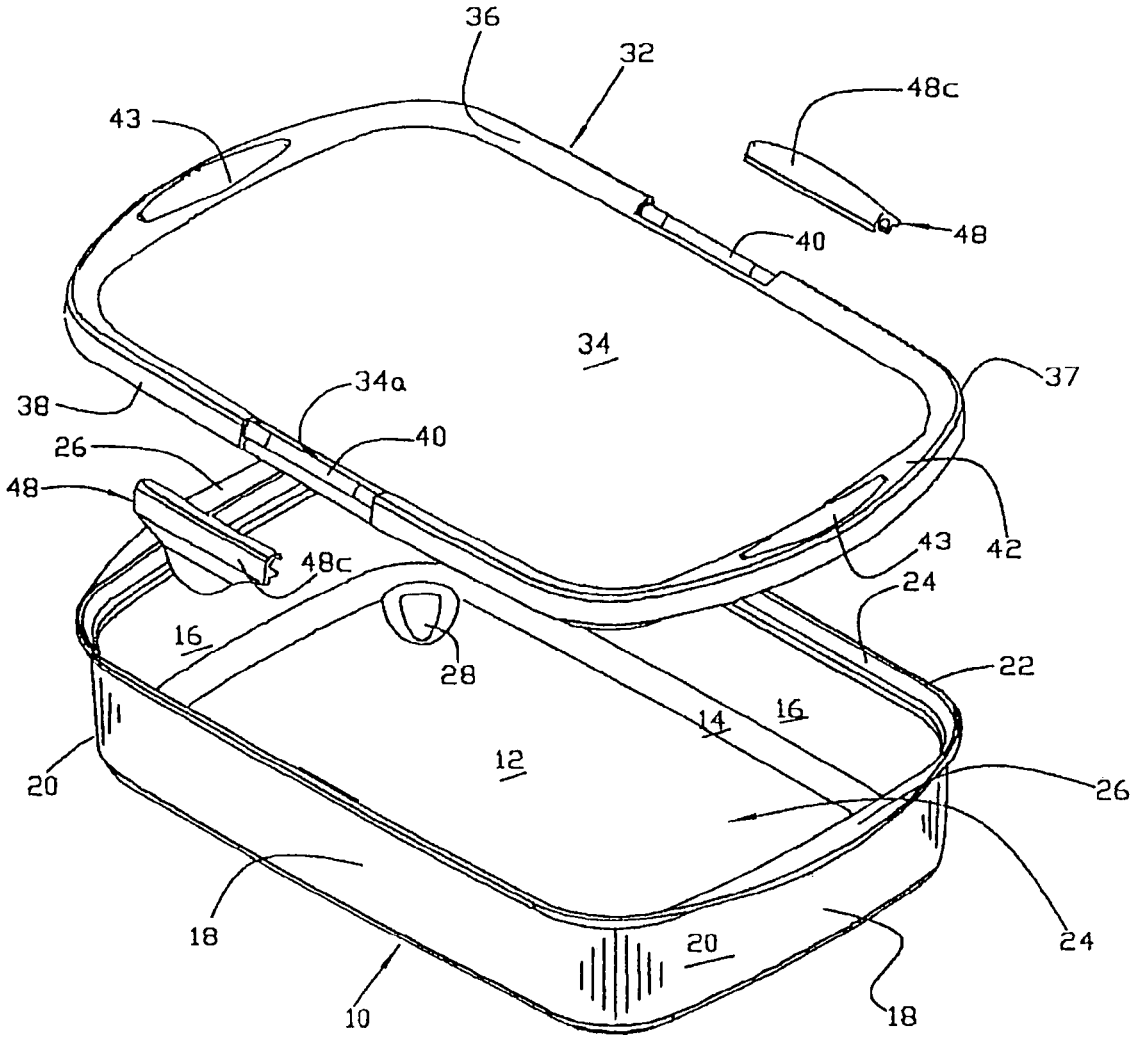
FIG. 1 is a perspective top view of a container and cover in accordance with the present invention showing the cover in a separated condition with the latch handles unassembled.

Referring now to FIGS. 1–4, the container 10 of the present invention includes a flat bottom wall 12 which merges at its periphery, via a rounded corner 14, with a peripheral wall, comprising end walls 16 and side walls 18. As discussed previously, while the container shown in the drawings has a rectangular shape, the container of the present invention may have a circular or oval shape with only a peripheral upstanding wall. The end and side walls of the container 10 are merged, via rounded corners 20, as shown. The peripheral wall (16, 18) terminates in an upper edge 22, via an outwardly extending convex shaped segment 24. The edge 22 surrounds and defines an open top or mouth 25 of the container 10 and forms a pair of horizontally protruding handles 26 above the end walls 16 as shown. The top surface of the handles are substantially level with the plane of the edge 22 simplifying the manufacturing process and allowing the cover to overlie the handles as illustrated for example in FIG. 12 to be described. The bottom wall 12 of the container projects downwardly at the corners forming triangular shaped protruding feet 28.

Figure 13A:
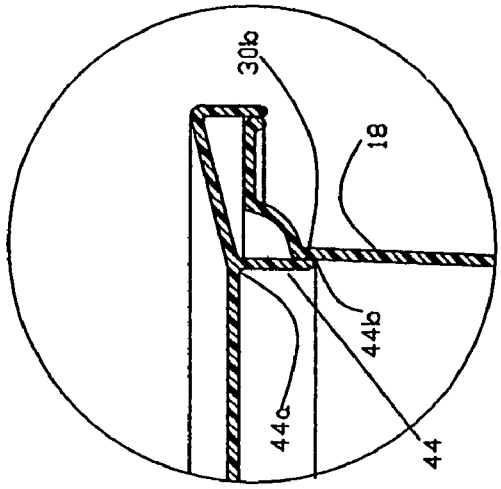
FIG. 13*a* is a enlarged sectional view of the right medial end of the assembled container and cover showing (a) the interference fit between the cover sealing flange and the inside surface of the upper portion of the container side wall and (b) the configuration of the end section of the cover overlying the container handle.
Figure 4:
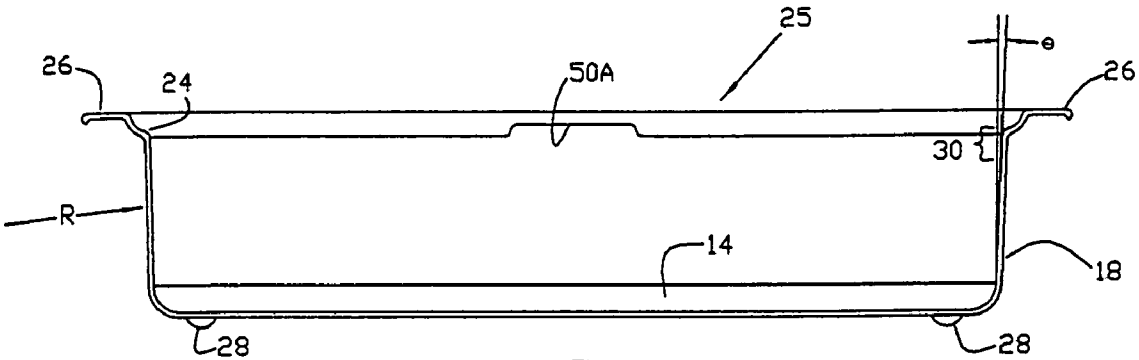
FIG. 4 is a cross-sectional view of the container taken along lines 4—4 of FIG. 3 showing the angle that the upper portion of the container side wall makes with the vertical.

The peripheral wall (16,18) has a slight convex surface, preferably formed along a radius R of about 75 inches, so that an upper section 30 of the peripheral wall (extending below the curved segment 24) is disposed at about an angle θ of 2° to 5° and preferably about 3° to the vertical with the bottom 12 lying in a horizontal plane as is illustrated in FIG. 4. This slight angle facilitates the entry of a peripheral sealing flange or fin 44 on the cover, to enter the mouth of the container and form an interference or sealing fit with an inner sealing surface 30*b* formed on a lower portion of the wall section 30 when a cover 32 is seated onto the container, as will be explained in more detail. See FIGS. 4 and 13*a*.

Figure 5:
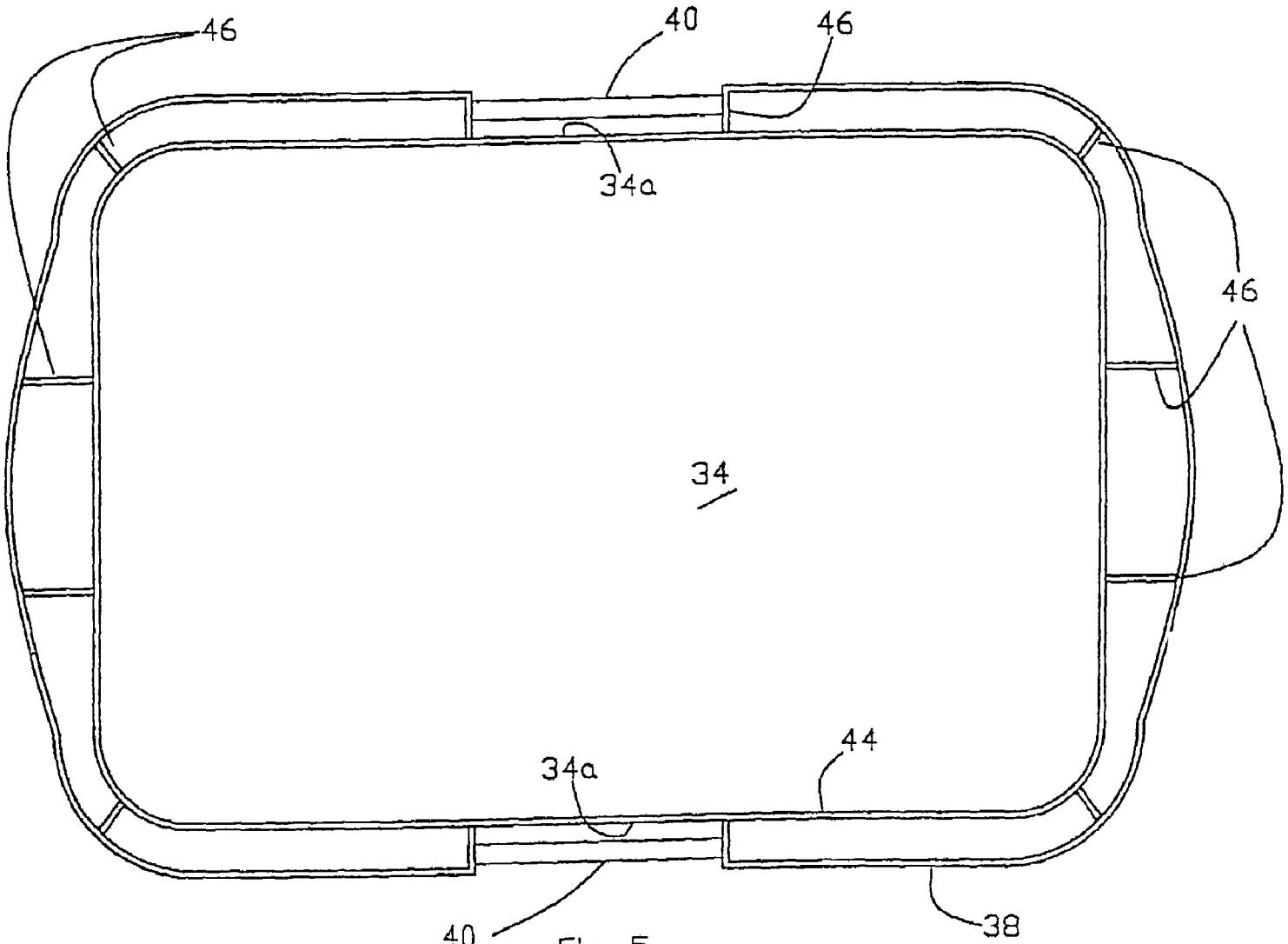
FIG. 5 is a bottom plan view of the cover.
Figure 6:
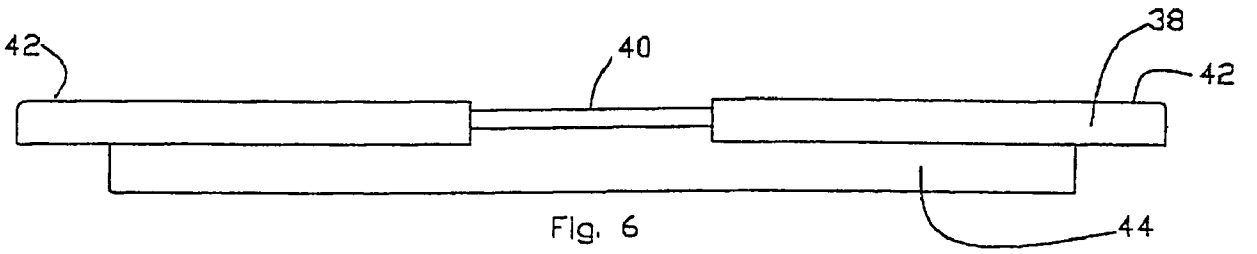
FIG. 6 is a side elevational view of the cover.
Figure 7:
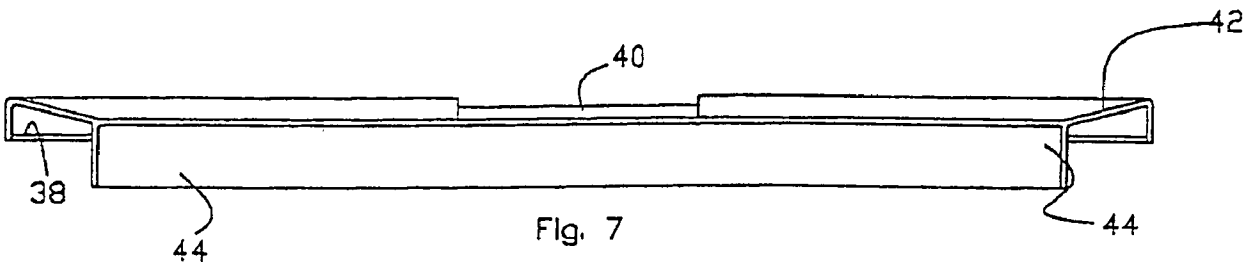
FIG. 7 is a cross-sectional view of the cover taken along lines 7—7 of FIG. 5.

Referring now to FIGS. 1, 2 and 5–8, a replaceable cover or lid 32 for use with the container 10 is formed with a generally planar depressed wall section 34 which merges with an upwardly inclined peripheral section 36 joined along apex 37 to a downwardly extending outer rim flange or skirt 38. The top of the cover, i.e., wall 34 and section 36 forms a dish-like shape for receiving the bottom of a like container/lid combination in a nesting arrangement. The outer flange or skirt 38 is interrupted by a pair of axel sections 40 which are spaced from the adjacent wall section 34 as is illustrated in FIGS. 1 and 5 to receive latching handles 48 to be described. The skirt 38 fits over the upper edge of the container except for the axel portions. The cover 32 includes extended end sections 42 which fit over the top of the container handles 26 in the assembled condition. The end sections 42 define slightly depressed oblong sections 43 which overlie and accentuate the container handles. See FIG. 13*a*.

Figure 2:
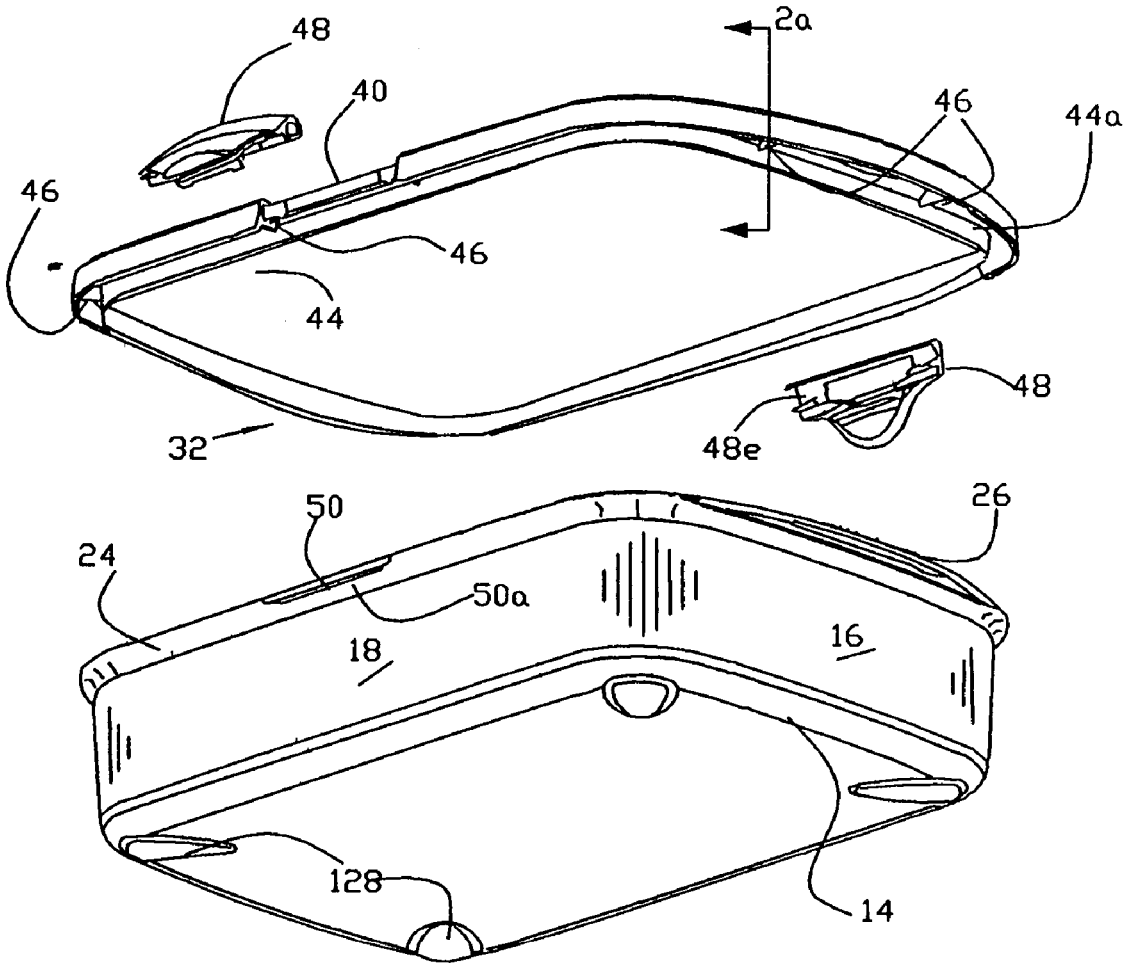
FIG. 2 is a perspective bottom view of the container/cover of FIG. 1 showing the bottom of the cover and container in some detail.
Figure 2A:
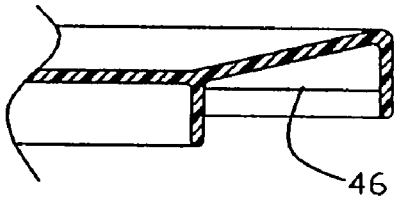
FIG. 2*a* is an enlarged partial cross-sectional view of the cover of FIG. 2 taken along lines 2*a*—2*a* showing the disposition of the ribs.
Figure 3:
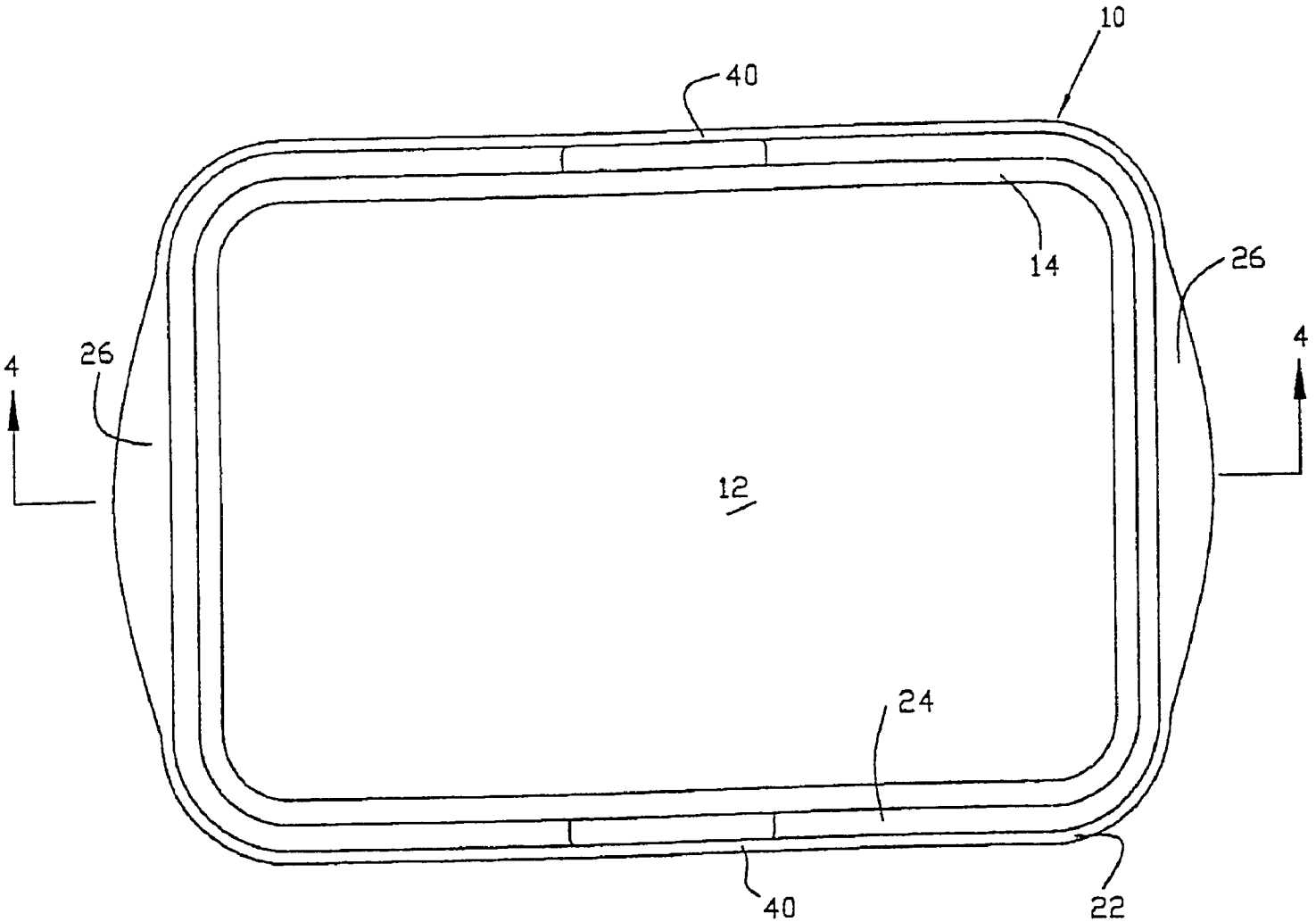
FIG. 3 is a top plan view of the container.

The cover 32 further includes a downwardly extending inner sealing flange, rib or fin 44 positioned inwardly of the outer skirt 38. The rib or fin 44 has a base 44*a* joined to the bottom of the wall section 34 and terminates in a free edge 44*b*. The sealing fin or at least the free edge thereof has a slightly greater periphery than the periphery of the inside sealing surface 30*b* of the peripheral wall of the container so that lower end of the fin 44 is deflected slightly inwardly by the inner sealing surface 30*b* of the wall section 30 in the assembled condition. The slight deflection provides an interference and sealing fit between the fin 44 and the inside surface 30*b* of the container peripheral wall. See, for example, FIG. 13*a*. The sealing flange, the outer rim skirt and the inclined peripheral section 36 of the cover form an inverted generally U-shaped cavity. Spaced vertical ribs 46 are formed along the underside of the peripheral section 36 and extend between the inner sides of the skirt 38 and the base of the sealing flange as shown in FIGS. 2 and 2*a* to serve as stop members to limit the downward movement of the cover and thereby control the extent or height of the seal between the cover sealing fin and the container sealing surface. The stop member, when abutted against the upper edge of the container, informs the user that a positive seal has been obtained.

In the embodiment just described the cover sealing flange or rib 44 is substantially vertical and the inner sealing surface 30*b* on the upper peripheral wall of the container is slanted or canted outwardly by the angle θ of say 2° to 5° degrees. In an alternative embodiment, to be described in conjunction with FIGS. 14–28, the cover sealing flange or rib is canted outwardly in its unstressed or unseated condition and the inner sealing surface of the container wall is generally vertically inclined. With this arrangement as with the embodiment of FIGS. 1–13, the lower portion of the cover sealing rib is forced inwardly against the container sealing surface to provide the sealing action when the cover is pressed downwardly over the mouth of the container.

Figure 13:
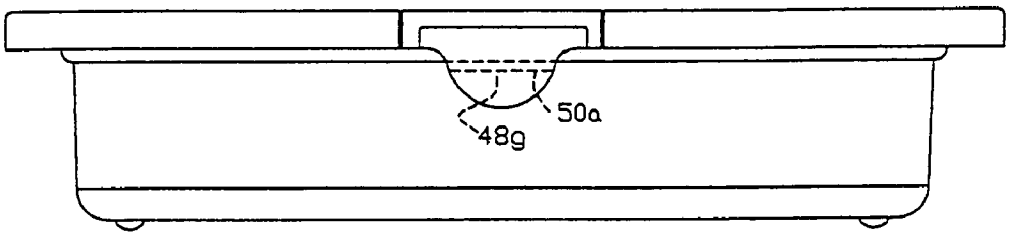
FIG. 13 is a side elevational view of the container and cover in an assembled and locked position.
Figure 9:
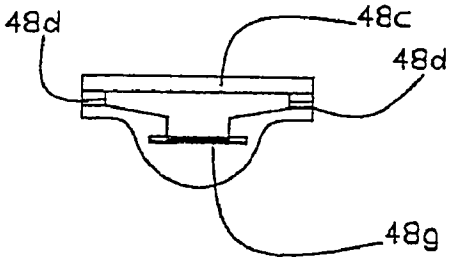
FIG. 9 is a bottom plan view of a latch handle.
Figure 10:
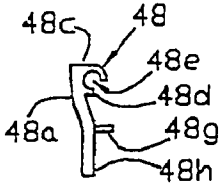
FIG. 10 is a side elevational view of a latch handle.
Figure 8:
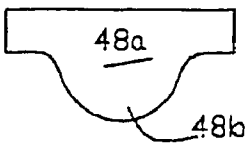
FIG. 8 is a top plan view of one of the latch handles.
Figure 11:
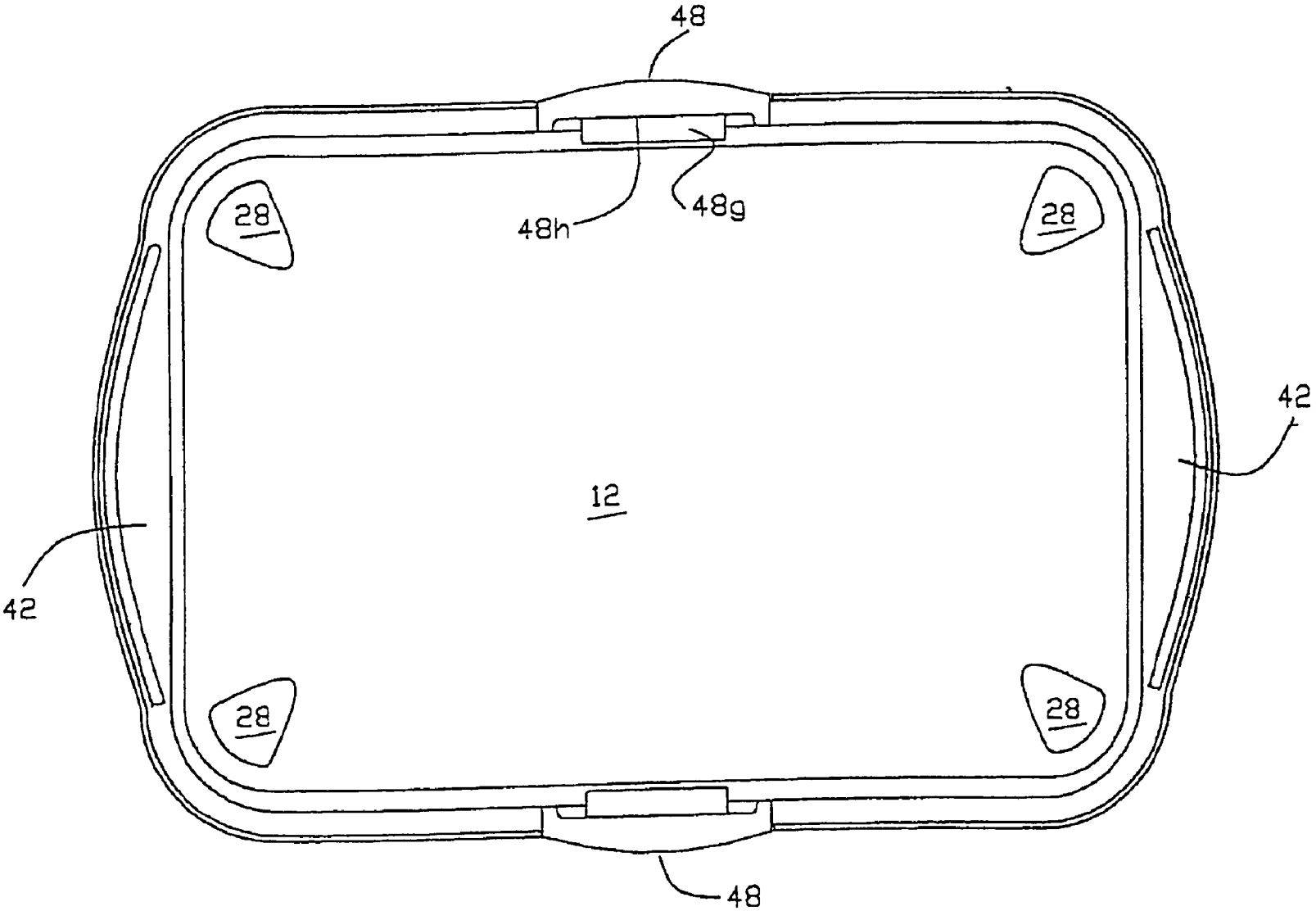
FIG. 11 is a bottom plan view of the container and cover in an assembled and locked position.

Referring again to the embodiment of FIGS. 1–13 and more particularly to FIGS. 8–10, the cover or lid 32 is removably secured (and sealed) to the container 10 by means of a pair of oppositely disposed latching handles 48 which engage the underside 50*a* of a pair of latch hooks 50 formed on the outside of the peripheral upper edge of the container wall as is illustrated by the dashed lines in FIG. 13. Each latch handle is formed with an upper surface 48*a* including an outwardly extending finger engaging surface 48*b*, a back wall 48*c* and a lower surface. The lower surface is formed with a pair of short protruding spaced inner walls 48*d* which together with the back wall form two semicircular recesses 48*e* with downwardly faced openings 48*f* for receiving an associated axel 40. The lower latch handle surface further forms a downwardly protruding locking tab 48*g* for engaging the lower edge 50*a* of an associated locking hook 50 on the container wall. Additionally the lower latch handle surface includes a finger engaging surface 48*h*.

The latch handles are assembled to the cover or lid 32 by spreading the inner walls 48 slightly away from the back wall 48*c* (in a snapping action) to allow each axel to enter the respective recess 48*e*. The back wall 48*c* of each latch handle limits the rotational movement of the associated latch handle to about 90° by engaging the edge 34*a* of the wall 34 when the upper surface of the handle is about parallel to the surface 34. It should be noted that the edge 34*a* may include a small upward curvature formed as part of the arched peripheral section 36.

As discussed previously and as illustrated in FIGS. 13 and 13*a*, skirt 38, while fitting over the upper edge of the container, except for the axel portions, does not extend under the upper peripheral edge of the container wall. As a result, only the latch handles serve to lock the cover and container together.

In use, the cover 32 with the latch handles assembled thereon, may be placed over the mouth or top 24 of the container 10 and then pressed downwardly until the ribs 46 are seated on the container's upper edge 22. In this position the inner sealing flange 44 forms an interference fit with the inside of the container peripheral wall. The latch handles may then be easily rotated to a closed position by pressing downwardly and inwardly on the finger engaging surfaces 48*b* until the locking tabs 48*g* snap under the locking hooks 50.

The locked container and cover, with the contents stored therein, is now ready for storage. To open the cover it is only necessary to rotate one or both of the latch handles to an unlocked position and lift the cover. If desired, one latch handle (or both) may be rotated to its upper most position and pressed upwardly (e.g., by a finger 52) while an area of the planar surface 34 of the cover adjacent the handle is simultaneously pressed downwardly (e.g., by a thumb 54). This simple maneuver causes the surface 34 to assume a slightly concave bow to break the seal and release the cover from the container. See FIG. 12.

Another preferred embodiment of a storage container and lid is illustrated in FIGS. 14–17. This embodiment is very similar to the embodiment of FIGS. 1–13 except that the sealing rib on the lid is canted outwardly and the inner sealing surface along the upper portion of the container peripheral wall is about vertical. The container 110, like the container 10, includes a flat bottom wall 112 which merges at its periphery, through rounded corners 114, with a peripheral wall, comprising end walls 116 and side walls 118. The end and side walls of the container 110 are merged through rounded corners 120. The peripheral wall (116, 118) terminates in an upper edge 122. The edge 122 surrounds and defines an open top or mouth 125 of the container 110 and forms a pair of horizontally protruding handles 126 above the end walls 116 as shown. The top surface of the handles are substantially level with the plane of the edge 122 simplifying the manufacturing process and allowing the cover to overlie the handles. The bottom wall 112 of the container projects downwardly at the corners forming triangular shaped protruding feet 128.

The uppermost section of peripheral wall (116, 118) has a short transition or lead in wall segment 123 extending below the upper edge 122 and above a surface 124*a* formed on the inside of an upper section 124 of the peripheral wall as is best illustrated in FIGS. 17*a*, 24*a*, 25 and 27. The surface 124*a*, which circumscribes the interior of the upper peripheral wall is referred to as the inside sealing surface. The short lead in segment 123 is inclined outwardly at an angle λ to the vertical. The angle λ and angle Φ (to be discussed) between the cover sealing rib or fin and the vertical must be correlated to allow the lid to be seated on the container with a reasonable amount of force. The angled lead in segment 123 and the inner surface 123*a* formed thereby facilitate the entry of an inner sealing rib or fin 144 (described below) on the cover to enter the mouth of the container and form a sealing fit with the generally rectangular sealing surface area 124*a* when a cover 132 is seated onto the container. This angled transition wall segment 123 also facilitates removal of the cover. See FIGS. 24 and 25. The transition wall segment may be about 1/16 to 1/8 inches in height. The angle λ should not exceed 45° and preferably is within the range of about 10° to 20° and most preferably about 15°. The inside sealing surface 124*a* of wall section 124 is generally vertically disposed. Reference numbers 127 and 129 (FIG. 17*a*) indicate the direction of vertical planes and horizontal planes, respectively, in relation to the container bottom 122. The rest of wall 118 below the wall section 124 may taper inwardly to the bottom 112, which facilitates nesting of two or more containers.

Figure 14:
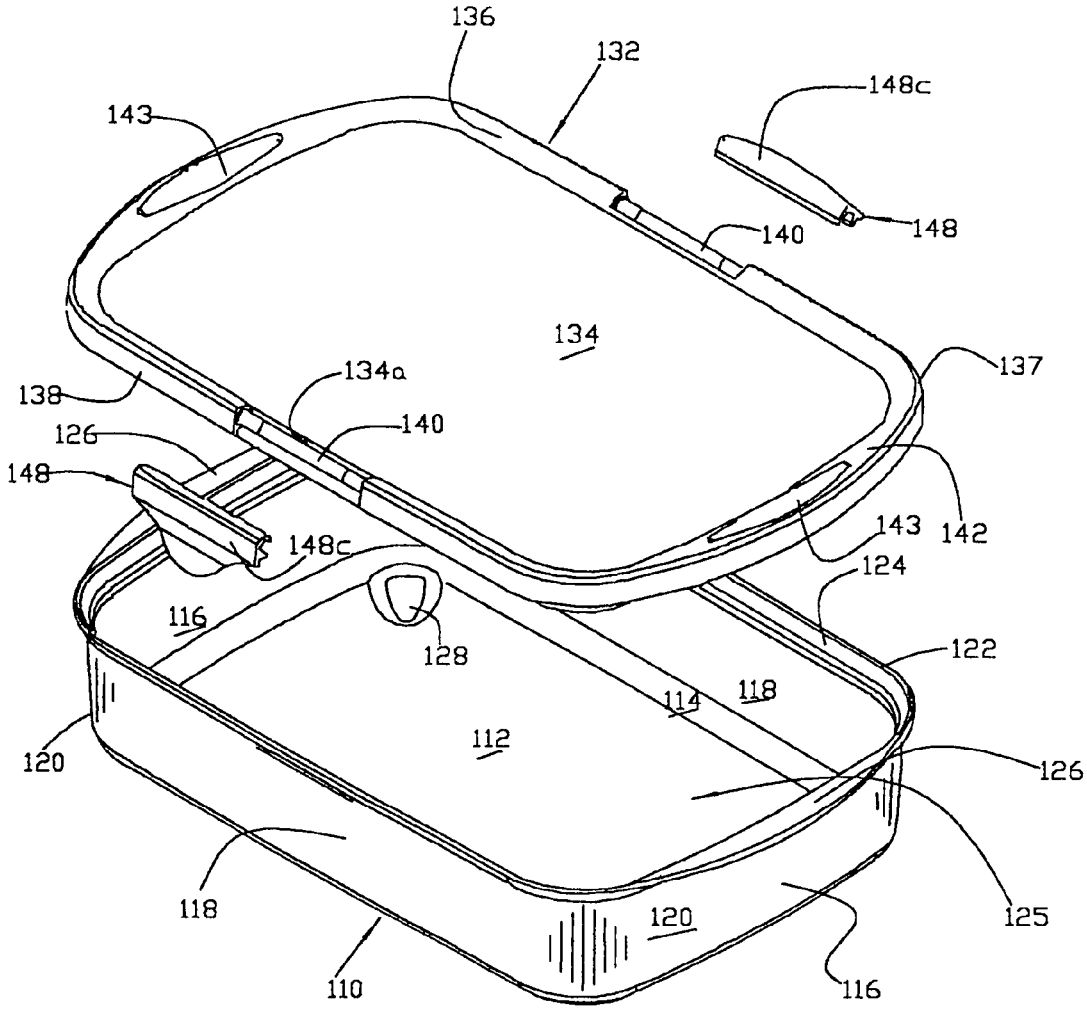
FIG. 14 is a perspective view of another container and cover in accordance with the present invention showing the cover in separated condition with the latch handles unassembled
Figure 18:
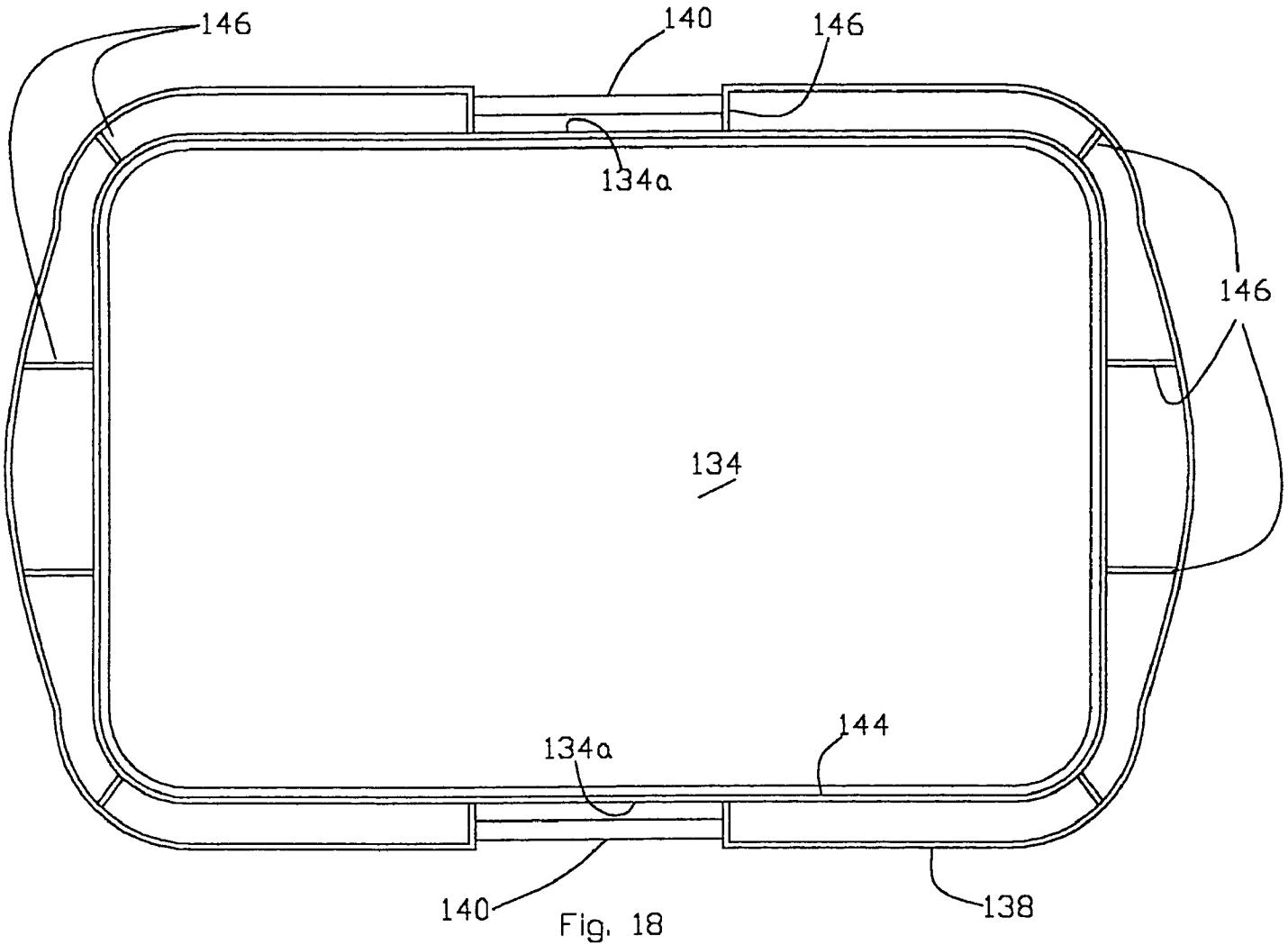
FIG. 18 is a bottom plan view of the cover.
Figure 19:
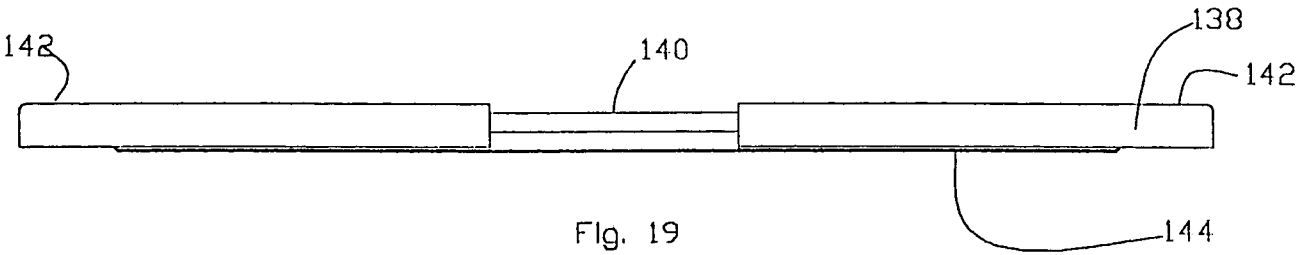
FIG. 19 is a side elevational view of the cover.
Figure 20:
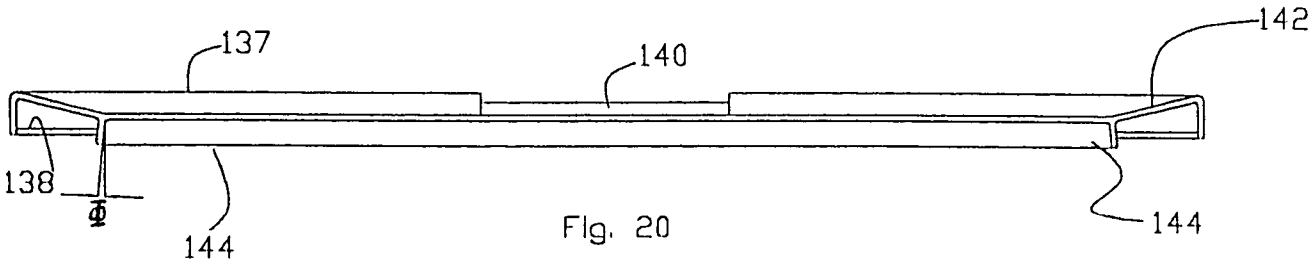
FIG. 20 is a partial cross-sectional view of the cover.
Figure 23:
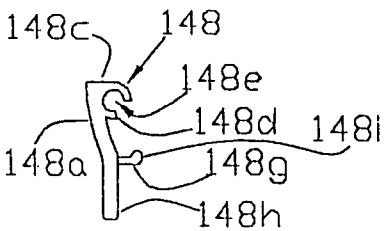
FIG. 23 is a side elevational view of a latch handle.
Figure 22:
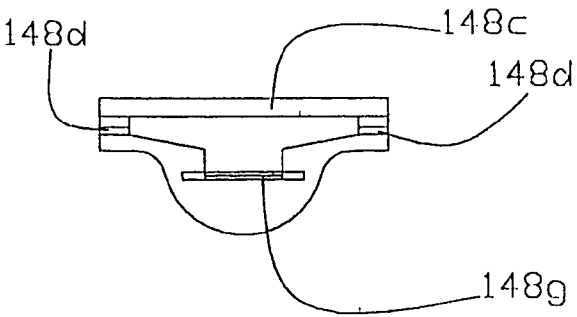
FIG. 22 is a bottom plan view of a latch handle.
Figure 21:
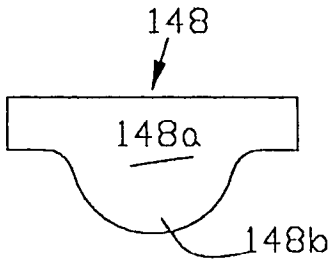
FIG. 21 is a top plan view of one of the latch handles.
Figures 24, 24A, 25:
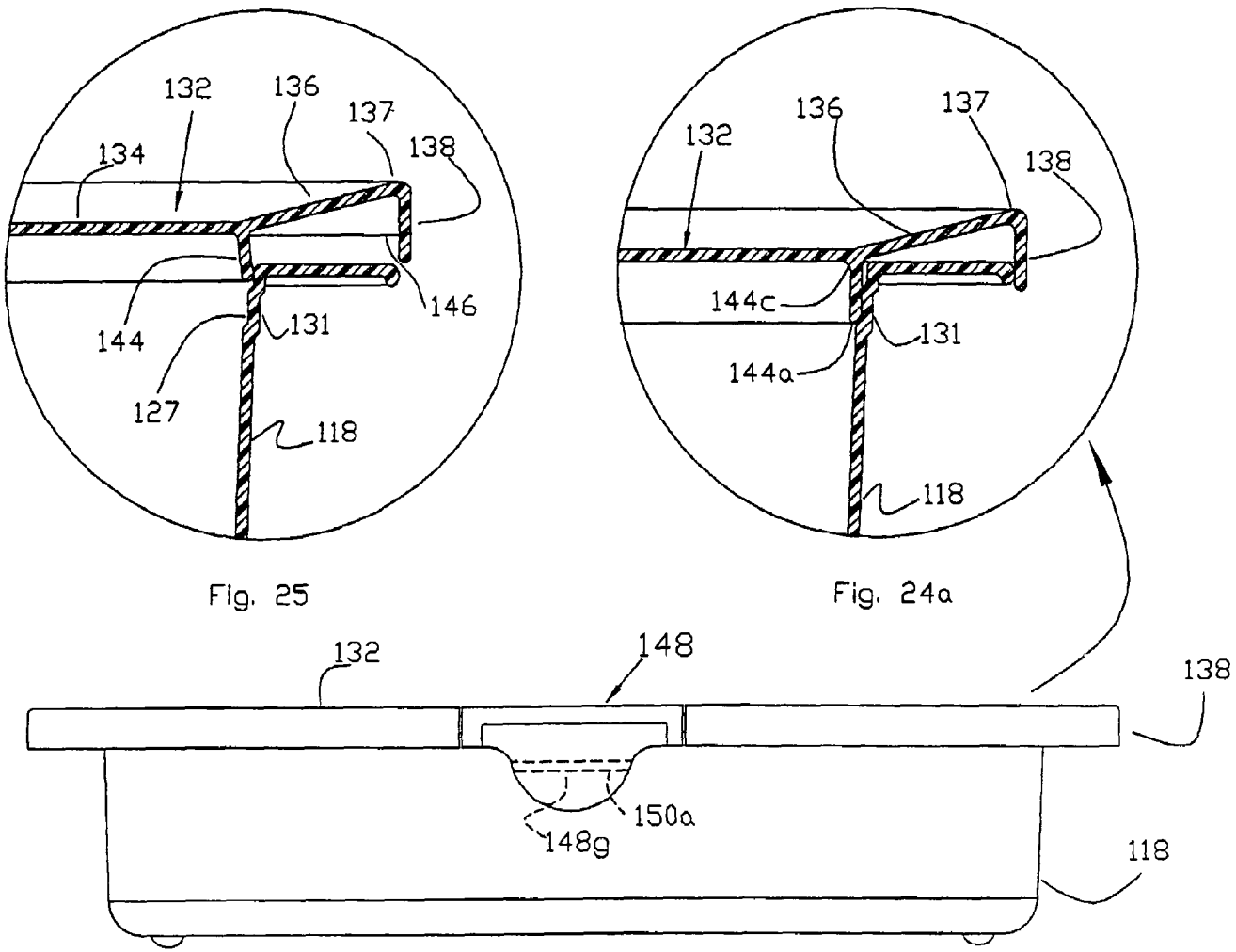
FIG. 24 is a side elevational view of the container and cover in an assembled and locked position.
FIG. 24*a* is an enlarged sectional view of the left medial end of the assembled container and cover showing (a) the sealing fit between the cover sealing fin and the inside surface of the upper portion of the container side wall and (b) the configuration of the end section of the cover overlying the container handle.
FIG. 25 is an enlarged sectional view of the left medial end of the assembled container and cover showing the cover sealing flange and the inside surface of the uppermost portion of the container side wall prior to flexure.
Figure 27:
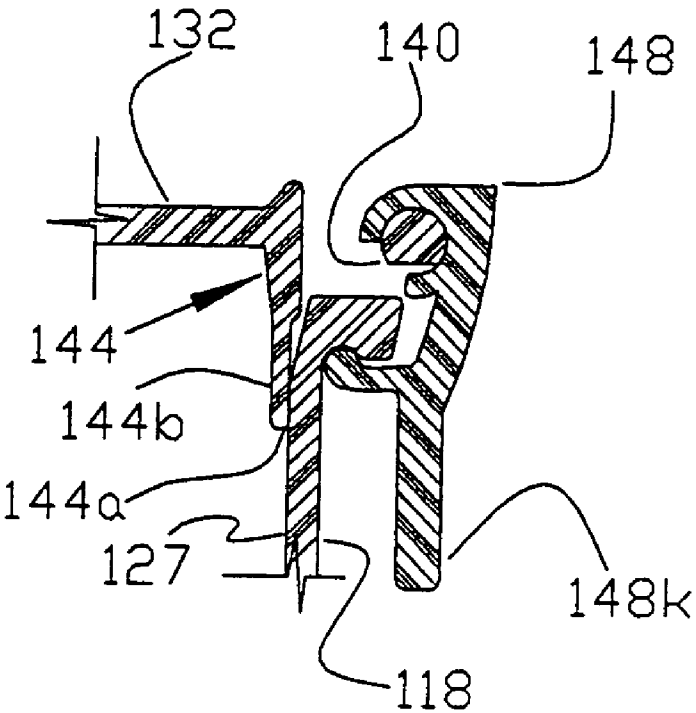
FIG. 27 is an enlarged sectional view of the latch handle rotated in its closed position.

Referring now to FIGS. 14, 15 and 18–20, a replaceable cover or lid 132 for use with the container 110 is formed with a generally planar depressed wall section 134 which merges with an upwardly inclined peripheral section 136 joined along apex 137 to a downwardly extending outer rim flange or skirt 138. The top of the cover, i.e., wall 134 and section 136 forms a dish-like shape for receiving the bottom of a like container/lid combination in a nesting arrangement. The outer flange or skirt 138 is interrupted by a pair of axel sections 140 which are spaced from the adjacent wall section 134*a* as is illustrated in FIGS. 14 and 18 to receive latching handles 148 to be described. The skirt 138 fits over the upper edge of the container except for the axel portions and like the skirt 38 of the cover 32, does not extend under the upper peripheral edge of the container wall. The cover 132 includes extended end sections 142 which fit over the top of the container handles 126 in the assembled condition. The end sections 142 define slightly depressed oblong sections 143 that overlie and accentuate the container handles. See FIG. 14.

The cover 132 further includes a downwardly extending inner sealing flange, rib or fin 144 positioned inwardly of the outer skirt 138. The flange or fin 144 is canted or inclined outwardly from the vertical through an angle Φ such that the free end 144*a* of the fin 144 is deflected or bent inwardly by the container inside sealing surface 124*a* with the lower half portion 144*b* of the fin being seated against the sealing surface 124*a* in the assembled condition. The cant or inclination angle Φ (FIG. 26) may be as great as 20° but preferably is in the range of about 4° to 8° and most preferably about 6°. The deflection of the fin 144 by the inside sealing surface 124*a* of the wall section 124 provides a bending force and consequentially a lateral force therebetween which enhances a sealing or interference fit between the fin 144 and the inside surface 124*a* of the container wall section 124. As will be noted the free edge 144*a* of the sealing fin 144 has a greater periphery than the periphery of the container inside sealing surface 124*a*. See, for example, FIG. 24*a*.

It has been discovered that a length to height ratio for the fin 144 is preferably about 4.0 to 5.0 and most preferably about 4.5 for ease of manufacturing the rib integrally with the cover by injection molding processes. A fin with a thickness of 0.055 inches at its base 144*c* would most preferably be 0.25 inches in height. The fin or rib 144 has a draft, i.e., thinner at the free end than at the base, of about 2° to 3°. The lower this height to width ratio the easier and more reliable the manufacturing process. The selection of the fin cant angle Φ, the height of the fin and placement of the fin on the cover in relation to the vertical sealing wall section 124 when the cover and container are mated are preferably selected such that about one-half of the fin's lower surface area is pressed into contact with the inner sealing surface 124*a*. The amount of flexure, i.e., bending of the sealing fin 144, preferably should not exceed 20% to 30% of the maximum yield strength of the fin. The vertical force required to seat the lid on the container may be of the order of 6 to 10 and preferably about 8 ounces per linear inch to accommodate the strength of the anticipated users while providing the desired seal.

Figure 15:
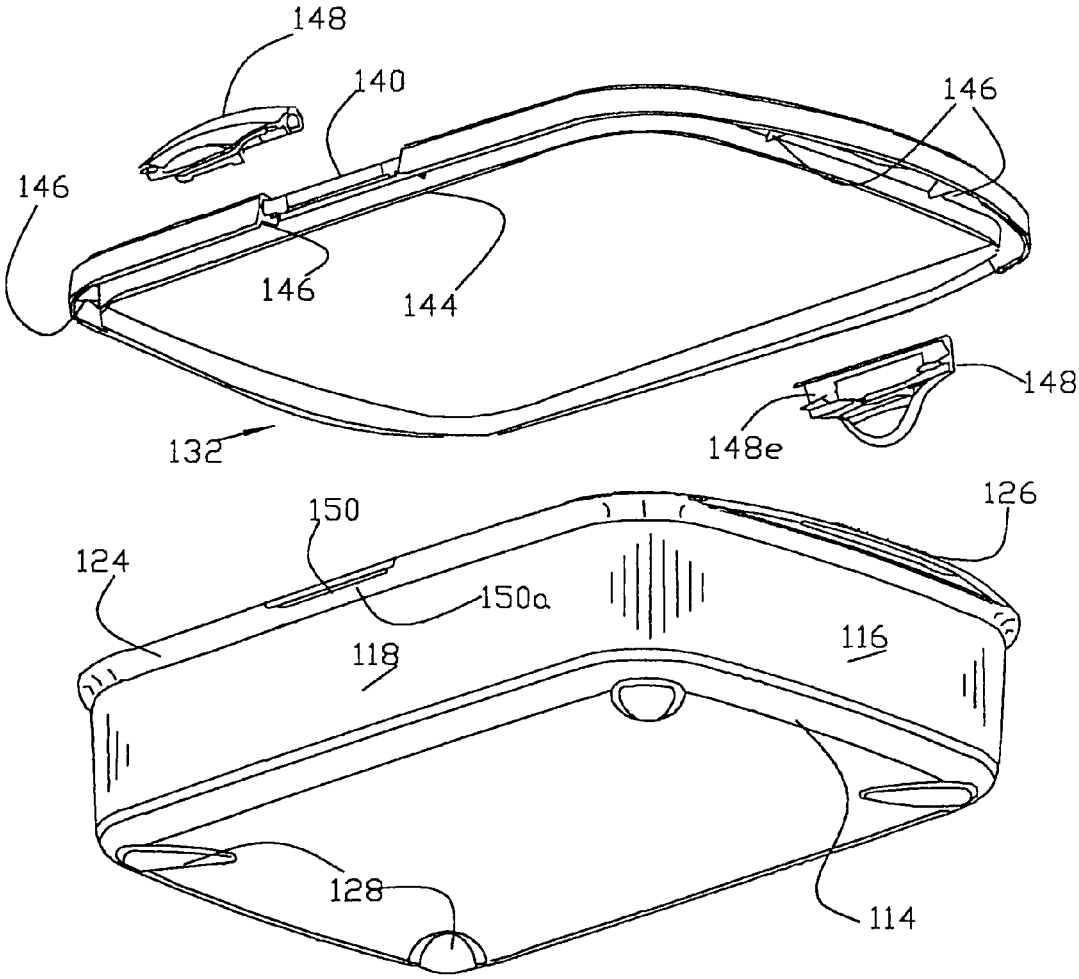
FIG. 15 is a perspective bottom view of the container/cover of FIG. 14 showing the bottom of the cover and container.
Figure 16:
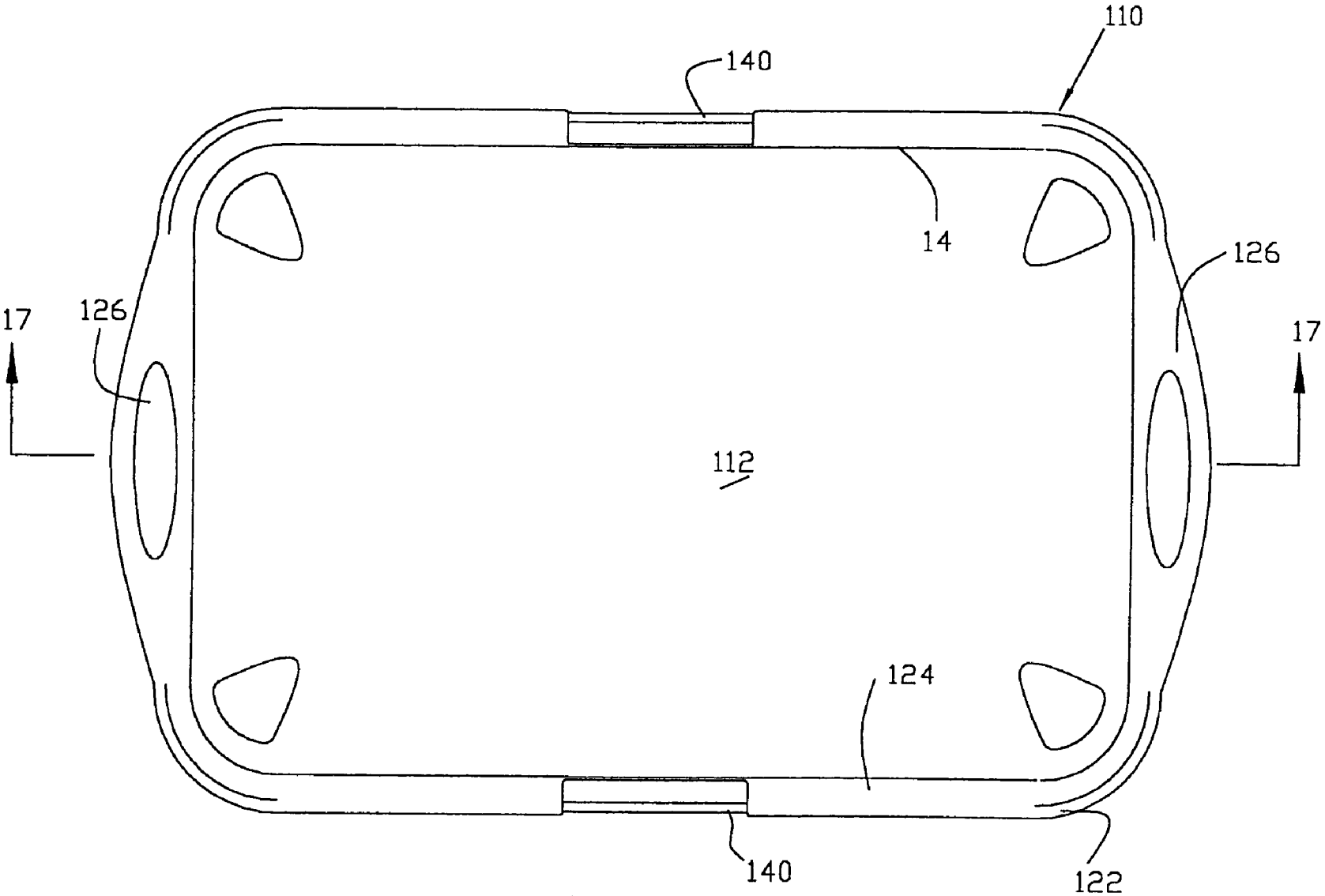
FIG. 16 is a top plan view of the container of FIG. 14.
Figure 17A:
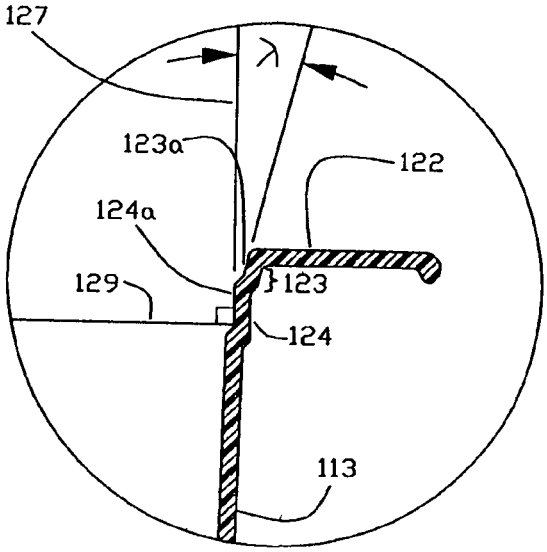
FIG. 17*a* an enlarged sectional view of the right medial end of the container showing the upper portion of the container.
Figure 17:
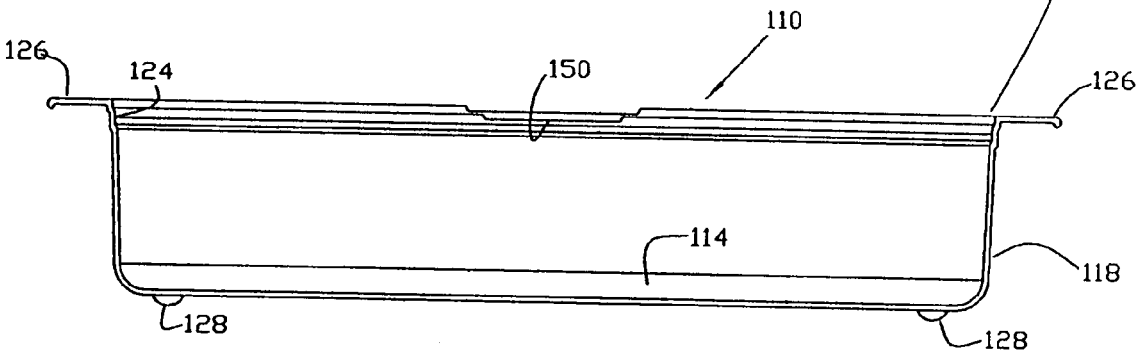
FIG. 17 is a cross-sectional view of the container taken along lines 17—17 of FIG. 16.

Spaced vertical ribs 146 are formed along the underside of the peripheral section 136 and the inner side of skirt 138 as shown in FIGS. 15 and 18 to provide structural rigidity and seat on the upper edge 122 of the container.

A pair of oppositely disposed latch handles 148 engage the underside 150*a* of a pair of latch hooks 150 formed on the peripheral upper edge of the container wall. Each latch handle is formed with an upper surface 148*a* including an outwardly extending finger engaging surface 148*b*, a back wall 148*c* and a lower surface. The lower surface is formed with a pair of short protruding spaced inner walls 148*d* which together with the back wall form two semicircular recesses 148*e* with downwardly faced openings 148*f* for receiving an associated axel 140. The lower latch handle surface further forms a downwardly protruding locking tab 148*g* with a bead 148*i* for engaging the lower edge 150*a* of an associated locking hook 150 on the container wall. Additionally the lower latch handle surface includes a finger engaging surface 148*h*.

Figure 26:
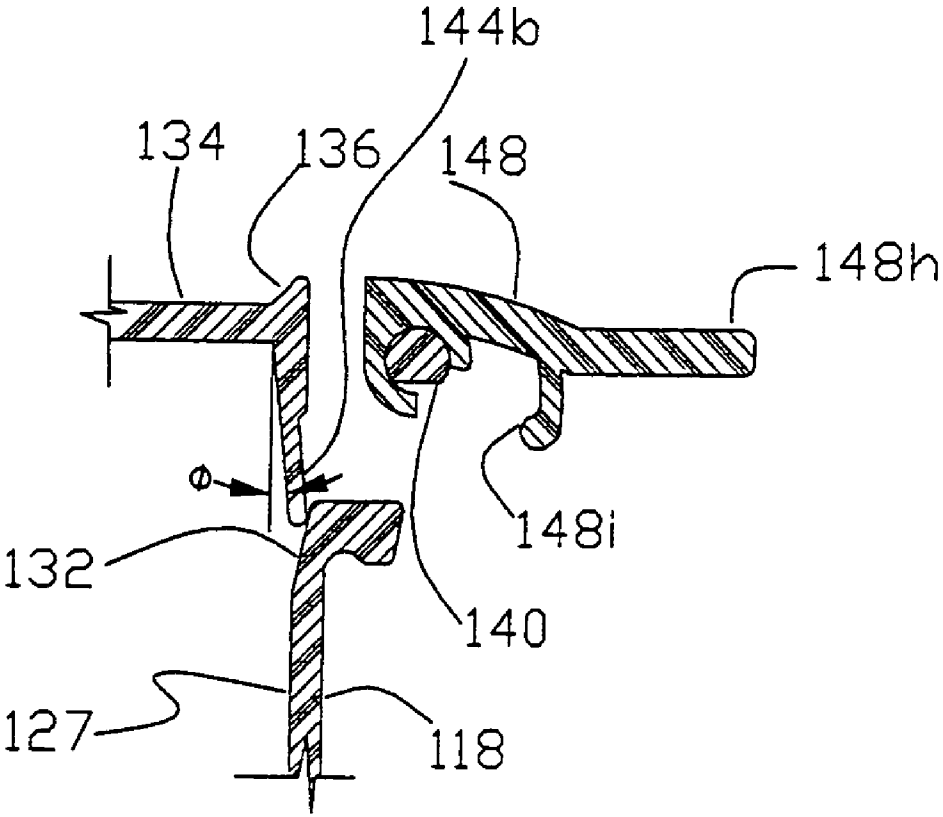
FIG. 26 is an enlarged sectional view of the latch handle in its open position.
Figure 28:
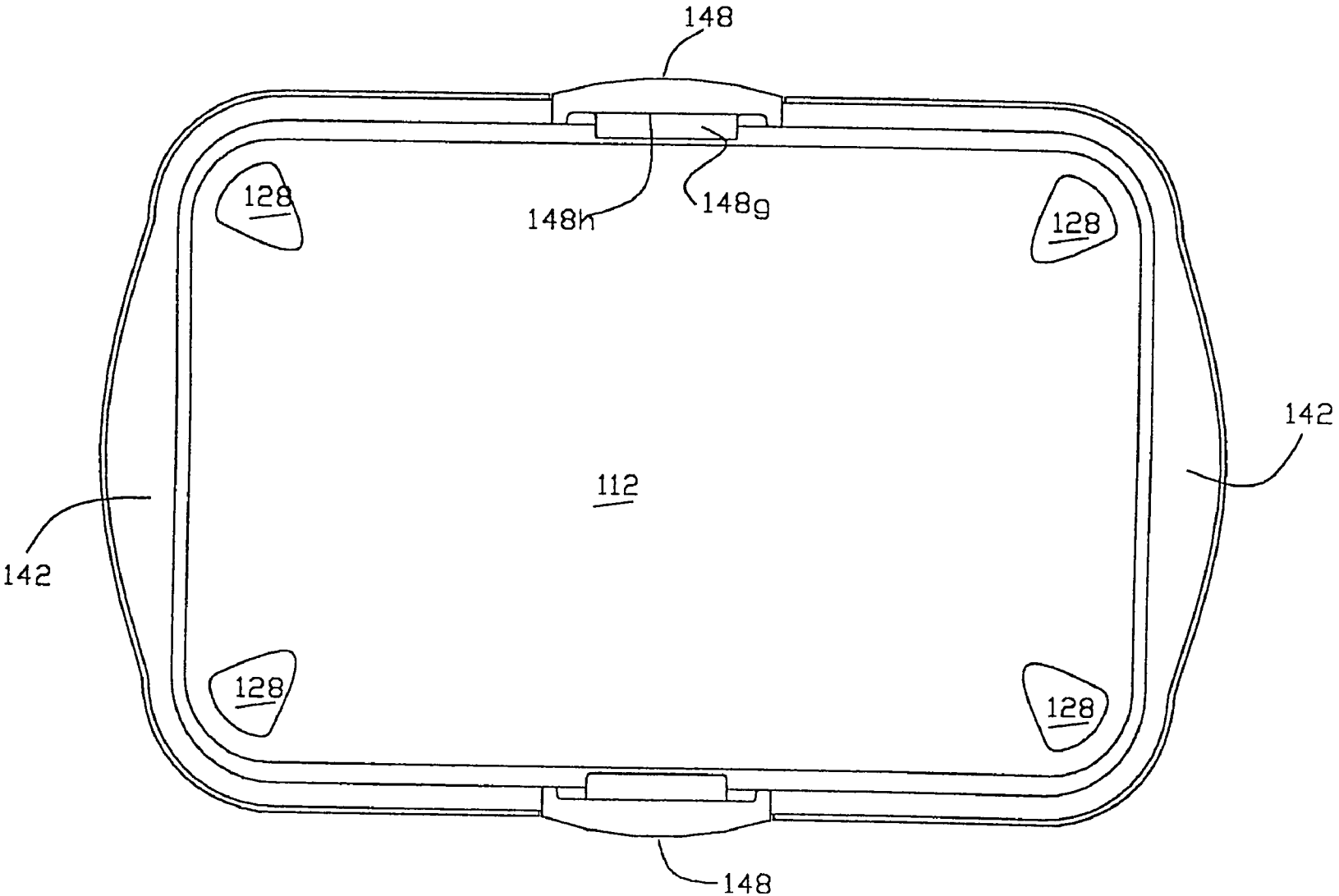
FIG. 28 is a bottom plan view of the container and cover in an assembled and locked position.

The latch handles 148 are snapped onto the axels 140 and the cover 132 placed over the mouth or top 125 of the container 110 with the fin inserted into the transition segment facilitating the assembly process. See FIGS. 24 and 25. The cover 132 is then pressed downwardly until the ribs 146 are seated on the container's upper edge 122. In this position the sealing fin 144 forms a seal with the inside of the container. See FIGS. 23*a* and 26. The latch handles 148 may then be easily rotated to a closed position by pressing downwardly and inwardly on the finger engaging surfaces 148*b* until the locking tabs 148*g* is rotated to snap the bead 148*i* under the locking hooks 150 as illustrated in FIG. 26.

Figure 12:
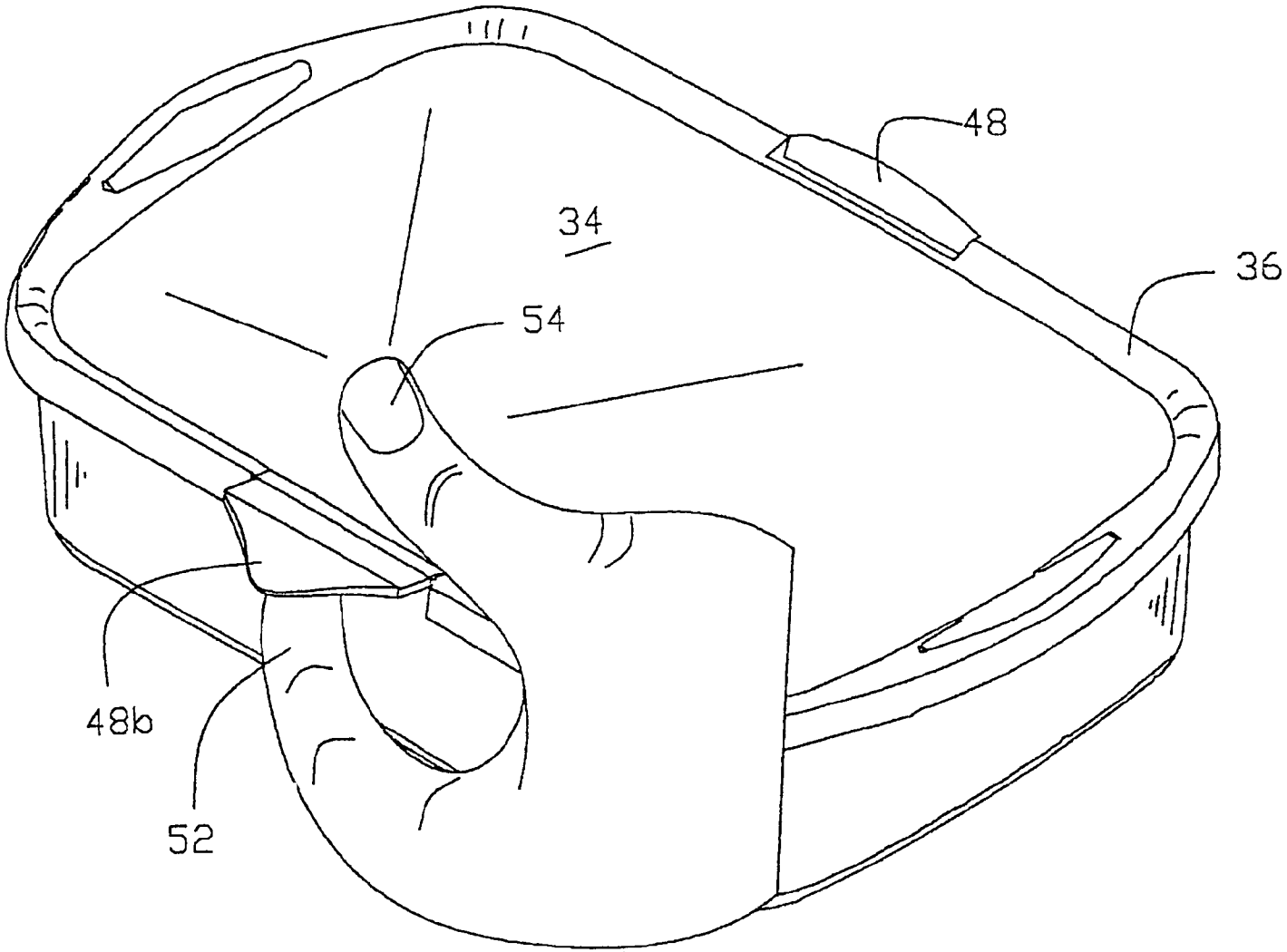
FIG. 12 is a top perspective view of the container and cover with one of the latch handles rotated to its fully upright position illustrating the simultaneous application of upward pressure to the latch handle and downward pressure to the cover for breaking the seal and releasing the cover from the container.

Removal of the cover from the container may be accomplished similarly to the first above-described embodiment as described and illustrated with reference to FIG. 12.

The container (10, 110) may be made (i.e., injection molded) of a suitable rigid or semi-rigid plastic such as polypropylene, but is preferably made of polycarbonate which is suitable for microwave and conventional dishwasher use. While the bottom of the container may be frosted the sides are preferably transparent or translucent to enable the food or material stored in the container to be readily viewed. It should be noted that to vent excess gas pressure from the container interior (as a result of cooking) it is only necessary to unlatch one of the latch handles.

The cover or lid (32, 132) as well as the latch handles may also be made of a suitable plastic, but are preferably made of polypropylene, having sufficient rigidity so that the inner flange of skirt (44, 144) forms an interference or sealing fit with the inner surface of the container wall in the assembled condition. The cover also preferably has sufficient beam strength and flexibility so that when an upward force is exerted on the finger engaging lower surface (48*h*, 148*h* of one or both latch handles (when in their upward most position) and a downward force is exerted on the planar top cover surface adjacent the latch handle the outer rim flange (38, 138) will flex outwardly and upwardly to break the seal and disengage the cover from the container. This feature adds to the user friendliness of the container/lid arrangement and particularly for persons suffering from arthritis or tendinitis of the hands an wrists.

The above-described storage container/cover arrangements can be made in a variety of sizes, i.e., lengths, widths and depths (e.g., 12"×7½"×2" etc.), with or without a designed stacking system. The container with the cover removed may be used as a serving dish.

There has thus been described improved, simple and inexpensive container/cover combinations which provides a reliable sealing system for food stuffs. Various modifications of the combination will occur to persons skilled in the art without involving any departure from the spirit and scope of the invention as defined in the appended claims.

What is claimed is:

1. The combination of a container having an open top and a cover for sealing the open top container comprising:

a one-piece container having a bottom wall and an upstanding peripheral wall extending upwardly from the bottom and terminating in an upper edge surrounding an open top, the upper portion of the peripheral wall defining an inside sealing surface;

a one-piece cover having a top wall with a down turned periphery terminating in an outer rim flange for fitting over at least a substantial portion of the upper edge of the container, the cover having a downwardly extending sealing flange circumscribing the cover inwardly of the outer rim flange, the inner sealing flange tapering outwardly and having a lower section terminating in a free edge with the free edge having a perimeter greater than the perimeter of the inside sealing surface of the container peripheral wall so that when the cover is pressed downwardly over the open top container the sealing flange free edge is forced inwardly to provide an interference fit between the lower section of the sealing flange and the container wall sealing surface, said interference fit providing the only seal between the cover and the container; and a pair of latch handles pivotally mounted on opposite sides of the cover adjacent the outer rim flange thereof, each latch handle defining an upper and lower surface, the lower surface having a protruding locking tab extending downwardly from the lower surface arranged to snap under a section of the peripheral upper edge of the container side wall when the latch handle is rotated downwardly to lock the cover in place over the container open top with the inner sealing flange engaging the upper portion of the container side wall to secure the cover over the open top, each latch handle further defining a manually actuable tongue extending outwardly of the locking tab, whereby a user may break the seal and release the cover by pressing the tongue of each latch upwardly with a finger of one hand while simultaneously pressing an area of the top wall of the cover adjacent the latch handle downwardly with another finger of the hand.

2. The container and cover of claim 1 wherein Φ represents the inclination of the cover sealing flange with the vertical and wherein Φ is within the range of about 4° to 20°.

3. The container and cover of claim 2 wherein Φ is within the range of about 4° to 8°.

4. The container and cover of claim 3 wherein Φ is about 6°.

5. The container and cover of claim 3 wherein the peripheral wall of the container defines an inner lead in surface which is inclined outwardly at an angle λ to guide the cover sealing flange into the container sealing surface.

6. The container and cover of claim 5 wherein λ is within the range of about 10° to 20°.

7. The container and cover of claim 1 wherein the cover defines an inverted generally U-shaped cavity and further including spaced stop members disposed in the cavity for engaging the upper edge of the container to limit the downward movement of the cover relative to the container.

8. The container and cover of claim 1 wherein the top wall of the cover has such resiliency and strength that when pressed downwardly adjacent a latch handle while the manually actuable tongue of the latch handle is pressed upwardly from an unlocked position, the outer rim flange will flex upwardly and outwardly to facilitate the removal of the cover.

9. The container and cover of claim 1 wherein the outer rim flange of the cover defines a pair of axels on opposite sides of the cover, each latch handle defining a cooperating groove which fits over the associated axel to provide the pivotal mounting of the latch handles.

10. The container and cover of claim 9 wherein the container is generally rectangular in shape.

11. The container and cover of claim 10 wherein the axels are spaced outwardly from the cover top wall and each latch handle defines a back wall which engages the cover top wall to limit the rotational movement of the latch handle when rotated in an unlocking direction.

12. The container and cover of claim 11 wherein the rotational movement of each latch handle is limited to an angle of about 90° from a locked to an unlocked position.

13. The container and cover of claim 12 wherein the top wall of the cover has such resiliency and strength that when pressed downwardly adjacent the latch handles while the manually actuable tongues are pressed upwardly in the unlocked position, the outer rim flange will flex upwardly and outwardly to facilitate the removal of the cover.

14. The container and cover of claim 13 wherein the height to thickness ratio of the sealing flange is within the range of about 4.0 to 5.0.

15. The container and cover of claim 14 wherein the cover top wall is generally planar with an upwardly inclined section joined to the outer rim flange to form a dish-like shape to receive the bottom of another container.

16. The container and cover of claim 15 wherein the peripheral wall is formed along a radius.

17. A combination of a generally rectangular container having an open top and a rectangular cover for closing and sealing the open top when the cover is in a closed position comprising:

a one-piece generally rectangular container having a bottom wall and an upstanding peripheral wall forming side and end walls and terminating in an upper edge surrounding an open mouth, the upper edge defining a pair of horizontally extending handles on opposed end walls, the peripheral wall further defining a continuous upper inside sealing surface;

a one-piece generally rectangular cover having a top wall and an outer rim flange extending from the top wall along side and end walls, the outer rim flange being interrupted by a pair of axels on opposing side walls, and fitting over the upper edge of the container except for the axles in the closed position, the cover having a continuous downwardly extending inner sealing flange canted outwardly at an angle Φ to the vertical and terminating with a free edge which has a greater periphery than the periphery of the container inside sealing surface which the free sealing edge contacts in the closed position so that in the closed position the free edge of the sealing fin applies an outwardly directed horizontal pressure to the container inside sealing surface to establish a seal between the container inside sealing surface and the sealing flange; and a latch handle pivotally mounted on each axle, each latch handle defining an upper and lower surface with a protruding locking tab extending downwardly from the lower surface and arranged to snap under a section of the peripheral upper edge of the container when the latch handle is rotated downwardly to lock the cover in place over the container open top with the inner sealing flange engaging the upper portion of the container side wall to secure the cover over the open top, each latch handle further defining a manually actuable tongue extending outwardly of the locking tab, whereby a user may break the seal and release the cover by pressing the tongue of each latch upwardly with a finger of one hand while simultaneously pressing an area of the top wall of the cover adjacent the latch handle downwardly with another finger of the hand.

18. The container and cover of claim 17 wherein the Φ is within the range of about 4° to 20°.

19. The container and cover of claim 18 wherein Φ is within the range of about 4° to 8°.

20. The container and cover of claim 17 wherein the cover defines an inverted generally U-shaped cavity between the outer skirt and the inner sealing fin and further including spaced stop ribs disposed within the cavity for engaging the upper edge of the container wall to limit the downward movement of the cover relative to the container.

21. The container and cover of claim 17 wherein the height to thickness ratio of the sealing flange is within the range of about 4.0 to 5.0.

22. The container and cover of claim 17 wherein the cover top wall is generally planar with an upwardly inclined section joined to the outer rim flange to form a dish-like shape to receive the bottom of another container.

23. A container/lid for storing food stuffs comprising:

a one-piece lid having a top wall with a downturned peripheral wall and an annular downwardly depending sealing fin disposed inwardly of the downturned peripheral wall;

a one-piece container with a circumscribing wall having an inner surface and a peripheral upper edge defining a mouth, the upper portion of the inner surface of the circumscribing wall defining an outwardly tapering inner sealing surface, the annular downwardly depending sealing fin on the lid being arranged such that when the lid is mated with the container, the fin seats against the inner sealing surface of the wall applying horizontal pressure thereto and establishing a seal between the wall and the fin, the interface between the cover fin and the container sealing surface providing the only seal between the cover and container; and a pair of latch handles pivotally mounted on opposite sides of the cover, each latch handle defining an upper and lower surface with a protruding locking tab extending downwardly from the lower surface and arranged to snap under a section of the peripheral upper edge of the container circumscribing wall when the latch handle is rotated downwardly to lock the cover in place over the container open top with the cover fin engaging the inner surface of the container wall to secure the cover over the open mouth, each latch handle further defining a manually actuable tongue extending outwardly of the locking tab, whereby a user may break the seal and release the cover by pressing the tongue of each latch upwardly with a finger of one hand while simultaneously pressing an area of the top wall of the lid adjacent the latch handle downwardly with another finger of the hand.

24. The container and cover of claim 23 wherein the container inner sealing surface tapers outwardly at an angle Φ to about 2° to 5°.

25. The container and cover of claim 24 wherein the cover is made of polypropylene.

26. The container and cover of claim 24 wherein the container is made of polycarbonate.

27. A container/lid for storing food stuffs and the like comprising:

a one-piece rectangularly-shaped container having a bottom wall, a pair of side and end walls extending upwardly from the bottom wall and terminating in an upper edge surrounding a mouth, the upper portion of the side and end walls defining an interior rectangular sealing area;

a one-piece lid having a depressed planar top wall which merges into an upwardly extending medial portion joined to a downwardly extending outer rim skirt circumscribing at least the major portion of the lid, the lid having a downwardly extending sealing fin disposed inwardly of the skirt, the fin tapering outwardly at an angle Φ of about 4° to 8° and having a free edge with a slightly greater periphery than the periphery of the container sealing area so that the free edge of the fin is flexed inwardly to form an interference fit with the rectangular sealing area of the container end and side walls when the lid is seated over the container mouth the interference fit between the cover fin and the container sealing area providing the only seal between the cover and container; and a pair of latch handles pivotally mounted on opposite sides of the cover adjacent the outer rim skirt thereof, each latch handle defining an upper and lower surface with a protruding locking tab extending downwardly from the lower surface and arranged to snap under a section of the peripheral upper edge of the container side wall when the latch handle is rotated downwardly to lock the cover in place over the container open top with the inner sealing flange engaging the upper portion of the container side wall to secure the cover over the open top, each latch handle further defining a manually actuable tongue extending outwardly of the locking tab, whereby a user may break the seal and release the cover by pressing the tongue of each latch upwardly with a finger of one hand while simultaneously pressing an area of the top wall of the lid adjacent the latch handle downwardly with another finger of the hand.

28. The container/lid of claim 27 wherein the outer rim skirt of the lid is interrupted on opposite sides by a generally cylindrical axel spaced from the depressed top wall and wherein the latch handles are mounted on the axels.

29. The container/lid of claim 27 wherein the top wall of the lid has such strength and resiliency that when pressed downwardly adjacent the latch handles while the latch handles are forced upwardly the edges of the top wall will bow slightly upwardly adjacent the latch handles and release from the container.

* * * * *

UNITED STATES PATENT AND TRADEMARK OFFICE

CERTIFICATE OF CORRECTION

PATENT NO. : 7,090,089 B2
APPLICATION NO. : 10/717044
DATED : August 15, 2006
INVENTOR(S) : Lown et al.

It is certified that error appears in the above-identified patent and that said Letters Patent is hereby corrected as shown below:

Column 11, line 57, "Φ" should be --θ--.

Signed and Sealed this

Fourteenth Day of November, 2006

JON W. DUDAS
*Director of the United States Patent and Trademark Office*